United States Patent [19]

Bolan

[11] 4,207,215

[45] Jun. 10, 1980

[54] TILE AND GROUT CLEANER

[75] Inventor: Joseph A. Bolan, Cincinnati, Ohio

[73] Assignee: The Drackett Company, Cincinnati, Ohio

[21] Appl. No.: 952,365

[22] Filed: Oct. 18, 1978

Related U.S. Application Data

[63] Continuation of Ser. No. 859,511, Dec. 2, 1977, abandoned.

[51] Int. Cl.[2] ..... C11D 1/84; C11D 3/28; C11D 7/32

[52] U.S. Cl. ..... 252/542; 252/546; 252/550; 252/DIG. 7; 252/DIG. 11; 252/DIG. 14

[58] Field of Search ..... 252/524, 527, 542, 546, 252/DIG. 3, DIG. 7, DIG. 11, DIG. 14, 54.5, 550

[56] References Cited

U.S. PATENT DOCUMENTS

| | | | |
|---|---|---|---|
| 3,679,609 | 7/1972 | Castner | 252/527 |
| 3,840,481 | 10/1974 | Miller | 252/546 |
| 3,912,662 | 10/1975 | Martinsson et al. | 252/527 |
| 3,935,130 | 1/1976 | Hirano et al. | 252/542 |
| 3,956,198 | 5/1976 | Bauer | 252/542 |
| 3,965,048 | 6/1978 | Murtaugh | 252/527 |
| 4,020,016 | 4/1977 | Sokol | 252/546 |
| 4,028,261 | 6/1977 | Peterson et al. | 252/89 R |
| 4,046,706 | 9/1977 | Krezanoski | 252/106 |
| 4,104,187 | 8/1978 | Sibley et al. | 252/106 |
| 4,122,043 | 10/1978 | Kersnar et al. | 252/527 |

FOREIGN PATENT DOCUMENTS

| | | | |
|---|---|---|---|
| 608416 | 11/1960 | Canada | 252/546 |
| 1311737 | 10/1962 | France | 252/542 |
| 1446541 | 6/1966 | France | 252/546 |

OTHER PUBLICATIONS

McCutcheons–"Detergents & Emulsifiers," 1970, p. 149.

*Primary Examiner*—P. E. Willis, Jr.
*Attorney, Agent, or Firm*—Sharon A. Blinkoff; George A. Mentis

[57] ABSTRACT

A tile and grout cleaning composition is provided which consists essentially of about 1.5 to 7.0 weight percent of a sequestering agent expressed on a free acid basis; about 1.0 to 3.0 weight percent of an alkaline hydroxide; 1.0 to 4.0 weight percent of 2-heptadecyl-1-carboxymethyl-1-(2-hydroxyethyl)-2-imidazolinium chloride; and the balance is water wherein the composition is capable of existing as a thixotropic gel at room temperature and of forming a water-impermeable outer skin upon application of the composition to the tile or grout surface.

4 Claims, No Drawings

TILE AND GROUT CLEANER

This is a continuation of application Ser. No. 859,511, filed Dec. 2, 1977, now abandoned.

BACKGROUND OF THE INVENTION

Many cleaning products have been developed for cleaning ceramic tile and grout. Specifically, such cleaning involves the removal of hard water salts, soap scum or curd and greasy-type residues from such surfaces. Typically, such products contain wetting agents to penetrate the soil, sequestering agents for removing hard water salts and soap scum and possibly thickeners for preventing the running off of such products when they are applied to vertical surfaces. Typical of such cleaning compositions are those described in U.S. Pat. Nos. 2,371,623 to Henderson; 2,544,649 to Bersworth; 3,001,945 to Drew et al; 3,454,500 to Lancashire; 3,484,379 to Mankowich; 3,870,560 to Shumaker; 3,905,909 to Bauer; 3,965,048 to Murtaugh; 3,968,048 to Bolan; 4,020,016 to Sokol and 4,028,261 to Petersen et al.

Although such products perform quite well on ceramic tile surfaces which are relatively non-porous, they do not satisfactorily remove stains on grout surfaces which are much more porous. In contrast to the aforementioned prior art, Applicant has surprisingly found that quite effective tile and grout cleaning compositions can be obtained for removal of the soil and stains associated therewith by providing for a composition which is capable of existing as a thixotropic gel at room temperature and providing a water-impermeable outer skin upon application thereof to the tile or grout surface.

SUMMARY OF THE INVENTION

In accordance with Applicant's invention, a composition is provided for cleaning tile and grout which consists essentially of:

(a) from about 1.5 to 7.0 weight percent of a sequestering agent said concentration being expressed on a free acid basis;

(b) from about 1.0 to 3.0 weight percent of an alkaline hydroxide selected from the group consisting of the hydroxides of potassium, sodium and ammonium, the amount of hydroxide being such as to combine with the sequestering agent to form a salt thereof, resulting in substantially no free hydroxide in the composition;

(c) from about 1.0 to 4.0 weight percent of 2-heptadecyl-1-carboxymethyl-1-(2-hydroxyethyl)-2-imidazolinium chloride; and (d) the balance being water, wherein the composition is capable of existing as a thixotropic gel at room temperature and of forming a water-impermeable outer skin upon application of the composition to the tile or grout surface.

Optionally, the composition may additionally include up to about 6.0 weight percent of polyethylene glycol monostearate. The composition may also contain up to about 0.15 weight percent of sodium lauryl sulfate.

Also, the sequestering agent may be ethylenediaminetetraacetic acid.

DETAILED DESCRIPTION OF THE INVENTION

The novel compositions of the invention for the cleaning of tile and grout include a sequestering agent, an alkaline hydroxide, 2-heptadecyl-1-carboxymethyl-1-(2-hydroxyethyl)-2-imidazolinium chloride and water. It is most important that the composition be capable of existing as a thixotropic gel at room temperature and of forming a water-impermeable outer skin upon application to the tile or grout surface. This is necessary for three purposes:

(1) the gel form being required to keep the composition in contact with the soiled surface;

(2) the thixotropic property being necessary to allow the composition to be applied or dispersed from a pump spraying applicator, while permitting the product to set up as a semi-rigid gel upon application to the soiled surface; and (3) the formation of a water-impermeable outer skin (i.e. "skinning effect") upon application of the composition to the surface prevents loss of the water content from the composition to the atmosphere, thereby preventing the composition from drying out and losing its cleaning effectiveness.

Thus, the present tile and grout cleaning composition, in accordance with Applicant's invention, is quite different from and more effective than those previously disclosed in the prior art in providing for the capability of greater contact time between the composition and the soiled surface than has heretofore been obtained.

As was previously mentioned, the compositions can be conveniently applied to the tile and grout surface by dispensing from a pump spray valve, since the thixotropic behavior allows the composition to flow under the stress applied when the valve dispenser is actuated. Of course, this does not mean that the composition cannot be applied by other means, such as a damp sponge or rag.

The sequestering agents which are useful are those agents having the capability of chelating or complexing, particularly calcium and magnesium ions which are found in hard water. Thus, typically, the sequestering agents which are found to be useful are the alkaline hydroxide and ammonium salts of alkaline polyamine polycarboxylic acids and nitrilotriacetic acid (i.e. NTA). The alkaline polyamine polycarboxylic acids generally can be represented by the formula:

$$(HOOCCH_2)_2N[(CH_2)_xNCH_2COOH]_yCH_2COOH$$

wherein x and y may each independently be from 1 to 7.

Representative of some of these salts of amino polycarboxylates especially useful in the compositions of this invention are ethylenediaminetetraacetic acid, N-2-hydroxyethyl-ethylenediaminetetraacetic acid, N-2-hydroxyethyl-nitrilodiacetic acid, ethylenediaminetetraproprionic acid, and diethylenetriamine pentaacetic acid. The above described sequestering agents can be utilized in the compositions of this invention in all combinations, such as, for example, mixing of nitrilotriacetic acid and an alkylene polyamine polycarboxylic acid.

Generally from about 1.5 to 7.0 weight percent of the sequestering agent is preferred, the concentration being based on the free acid (i.e. not as a salt). At levels much below 1.5 weight percent, a loss of effectiveness occurs insofar as the ability of the composition to chelate the magnesium or calcium ions found in hard water stains. At levels much above 7.0 weight percent, there is a tendency for the gel to lose its stability and break down leading to undesirable phase separation of several ingredients.

The alkaline hydroxides are present in a concentration from about 1.0 to 3.0 weight percent and useful for primarily forming a salt of the aforementioned sequestering agents to make them soluble in water. Stable gels are obtained provided there is substantially no free excess hydroxide in the composition or perhaps only a slight excess thereof. Therefore, the concentration range provided above is most useful with the concentrations provided for the sequestering agents. Due to their ready availability and price, the alkaline hydroxides of choice for use herein may be the hydroxides of potassium, sodium or ammonium.

Amphoteric surfactants having a quaternary imidazolinium structure have been found to be useful in the cleaning compositions according to the invention, with particularly 2-heptadecyl-1-carboxymethyl-1-(2-hydroxyethyl)-2-imidazolinium chloride (supplied by the Miranol Chemical Co., Inc. as a 21 percent solution of active as the sodium salt called Miranol DM; or by Lonza Chemical Co., Inc. as Amphoterge S) being found to be most preferred because of its ability to cause a "skinning effect" when used in the composition. In other words, when the composition is applied to the tile or grout surface, usually vertically inclined, the composition immediately sets on the surface as a thixotropic semi-rigid gel with the outer surface thereof forming a thin outer layer or skin which prevents water from the gel composition from evaporating into the surrounding atmosphere. Thus, the composition may be left in contact with the soiled tile or grout surface for a much longer period of time (e.g. up to two hours or longer) without lose of cleaning effectiveness due to the gel drying out, and resulting in much greater cleaning effectiveness than heretofore has been attained.

It has been found useful to use between about 1.0 to 4.0 weight percent of the aforementioned imidazolinium chloride on the pure basis in the compositions of the present invention. At levels much below 1 weight percent, there is a tendency for the gel to become less stable, with an attendant loss in the "skinning effect" in reducing the evaporation rate of water from the gel after application to a tile surface. Whereas, at levels above 4.0 weight percent, no change in "skinning effect" appears to occur.

At concentrations of the imidazolinium of about 1.0 to 2.0 weight percent, it has been found preferable to additionally include up to about 6.0 weight percent of an emulsifying agent to stabilize the gel and maintain thixotropic properties. A useful emulsifying agent for this purpose has been found to be polyethylene glycol monostearate, which is supplied for example by Glyco Chemical Co. as Pegosperse 400 MS.

Additionally, it has been found desirable to include foaming agents which can aid in the removal of the soap scum, grease and hard water stains on tile and grout surfaces. The addition of up to about 0.15 weight percent of such agents have been found to be effective. Particularly useful are anionic surfactants such as sodium lauryl sulfate.

Other optional additives can be utilized in amounts up to about 10.0 weight percent. Included are various surfactants for special cleaning purposes such as non-ionics and anionics. Typical of the nonionics are ethoxylated octyl and nonyl phenols sold by the Rohm and Haas Company as their Triton series of surfactants. Typical of the anionic surfactants which can be included are sodium lauryl ether sulfate. Other optional additives include colorants, perfumes and bactericidal or germicidal agents in minor amounts.

It is, of course, preferably that the pH of the resulting gel composition be above 7 (i.e. alkaline) for gel stability and maintenance of the sequestering agent in the salt form for solubility in the gel. The cleaning composition, in accordance with the present invention, can be made by mixing the ingredients in almost any order. However, it is prefered to separately mix the alkaline hydroxide and the sequestering agent to obtain the salt form for the sequestering agent prior to mixing with the other ingredients. It is also preferred to initially heat the water to approximately 130° F. and then add the other ingredients thereto to promote rapid dissolution in the water. After such mixing and dissolution occurs, the mixture can then be cooled down to approximately 100° F., at which point the perfumes and colorants may be added as needed. Then the solution may be further cooled down to room temperature to allow the thixotropic gel to form.

In determining the stability of the thixotropic gels in the examples that follow, such gels were considered "stable" if they did not separate into multiple phases and were able to maintain their semi-rigid gel-like structure under the following conditions after:

(1) 28 days at 125° F.;

(2) 90 days at room temperature (i.e. about 68° F.);

(3) 90 days at 125° F.; and (4) a 3 cycle freeze test-in which one cycle constitutes freezing the composition for 24 hours, then letting it thaw for 24 hours; and repeating the cycle two more times.

Insofar as the cleaning "effectiveness" of the formulations in the following examples, a 4-point scale was used: excellent, good, fair and poor. If a cleaning formulation was judged fair or poor, it was not considered effective. If the rating was good or excellent, it was considered effective. For rating each of the formulations, two tests were used as described below in which 5 to 10 people were asked to rank the formulas according to the previously described rating system by observing the cleaning results obtained, using the below described test procedure.

In one test, dirty shower doors were obtained from the homes of several consumers which had been soiled under normal use. Upon these doors were applied the cleaning formulation utilizing a one-inch artist brush. The cleaning formulation was left on the soiled surface for at least 10 minutes, and no greater than 30 minutes, and the surface was gently wiped and rinsed, and the cleaning effectiveness ratings were made based on observation and averaged for a rating either "effective" or "not effective".

The second procedure involved heating a ceramic wall tile to 350° F. on a hot plate, then spraying the entire surface with a 0.2 weight percent solution of $FeCl_3$ in 300 parts per million hard water and allowing to dry. Then spraying the entire tile surface heavily with a 0.1 weight percent solution of Ivory soap in 300 parts per million hard water and allow to dry. The tile is removed from the hot plate and allowed to cool to room temperature. With a one-inch artist brush, one-half of the tile is coated with the formula being tested. After leaving the formula coating on for 10 to 30 minutes, the tile is gently wiped and rinsed in water. Cleaning effectiveness ratings are given based on observation. The 300 parts per million hard water was initially prepared by mixing in 1,000 milliliters of deionized water the following ingredients: 0.2368 grams of $CaCl_2$; 0.2104 grams $MgSO_4.7H_2O$ and 0.2064 grams $NaHCO_3$.

To obtain the cleaning effectiveness rating for each formulation in the following examples, a rating indicating "yes" for effective would mean that in both of the aforementioned tests the average rating was at least good or excellent. If either of the average ratings for the tests were fair or poor, than the effectiveness would be indicated as "no".

In the following examples, unless otherwise indicated, the definitions for each of the chemicals referred to in the examples is described below:

| Common Name | Chemical Name |
|---|---|
| 1. EDTA | Ethylenediaminetetraacetic acid |
| 2. EDTA ($Na_4$) | Tetrasodium Salt of Ethylenediaminatetraacetic acid |
| 3. EDTA ($K_4$) | Tetrapotassium Salt of Ethylenediaminetetraacetic acid |
| 4. EDTA ($NH_4$) | Tetraamonium salt of Ethylenediaminetetraacetic acid |
| 5. Versene 100 | 38% Solution of EDTA ($Na_4$) |
| 6. Equex "S" | Sodium Lauryl Sulfate (29% Active) |
| 7. Equex "SP" | Sodium Lauryl Sulfate (29% Active) |
| 8. Ampho-terge S | Substituted Imidazoline (25% Active) |
| 9. Miranol DM | 2-Heptadecyl-1-Carboxymethyl-1-(2-Hydroxyethyl)-2-Imidazolinium Chloride (20% Active) |
| 10. Pego-sperse 400 MS | Polyethylene Glycol Monostearate |
| 11. Triton X-100 | Octylphenoxy Polyethoxy Ethanol (100% Active) |
| 12. Triton N-101 | Nonylphenoxy Polyethoxy Ethanol (100% Active) |
| 13. Sipon-ES | Sodium Lauryl Ether Sulfate (27% Active) |
| 14. BTC-2125 | Antimicrobial agent-mixture of Alkyl Dimethyl Benzyl Ammonium Chloride (50% $C_{12}$, 30% $CH_{14}$, 17% $C_{16}$, 3% $C_{18}$) and Alkyl Dimethyl Ethyl Benzyl Ammonium Chloride (60% $C_{14}$, 30% $C_{16}$, 5% $C_{12}$, 5% $C_{18}$) sold by the Onyx Chemical Company |
| 15. Emcol TS-211 | Cationic Surfactant-Quaternary Ammonium Compound sold by Witco Chemical Corporation |
| 16. Monazol-line O | Cationic Surfactant - Substituted Imidazoline of Oleic Acid (100% Active) Supplied by Mona Chemicals |
| 17. GAFAC RA-600 | Anionic Phosphate Ester Surfactant sold by GAF Corporation |
| 18. ASE 200 | Polymer Thickener supplied by Rohm and Haas Company |

In the following examples, all percentages are weight percentages, unless otherwise indicated.

EXAMPLES 1–4

| | 1 | 2 | 3 | 4 |
|---|---|---|---|---|
| Miranol DM | 5.0% | 10.0% | 15.0% | 20.0% |
| $Na_4EDTA$* | 3.8 | 3.8 | 3.8 | 3.8 |
| $H_2O$ | 91.2 | 86.2 | 81.2 | 76.2 |

*Added as 10 parts of VERSENE 100, a 38% Active Solution (Dow Chemical Co.). One gram of each of these formulas were placed on bathroom tiles and the evaporative weight loss determined. The results are shown below.

| | % WEIGHT LOSS | | | |
|---|---|---|---|---|
| | 1 | 2 | 3 | 4 |
| One Hour | 43% | 10% | 7% | 7% |
| 18 Hours | 92 | 42 | 28 | 30 |

It was concluded that no more than 15% Miranol DM was necessary for weight loss reasons. Formula 3 had acceptable cleaning performance by tile tests and shower door tests.

EXAMPLE 5

The following composition was prepared.

| | |
|---|---|
| EDTA (acid) | 4.0% |
| Miranol DM | 4.0 |
| Pegosperse 400 MS | 3.0 |
| KOH | 2.25 |
| Sodium Lauryl Sulfate | 0.15 |
| Water | 86.6 |

This formula had the desired properties with respect to cleaning and thixotropy.

This formula had the desired properties with respect to cleaning and thixotropy.

EXAMPLES 6–9

| | 6 | 7 | 8 | 9 |
|---|---|---|---|---|
| EDTA acid | 1.5 | 3.0 | 1.5 | 0 |
| NaOH | 0.4 | 0.8 | 0.4 | 0 |
| Miranol DM | 10.0 | 10.0 | 15.0 | 15 |
| $H_2O$ | 88.1 | 86.2 | 83.1 | 85 |
| Tile Cleaning | Not Tested | Good | Good | Poor |

EXAMPLES 10–12

| | 10 | 11 | 12 |
|---|---|---|---|
| KOH | — | — | 2.25 |
| $H_20$ | 91.2 | 81.2 | 84.75 |
| NaOH | 0.8 | 0.8 | — |
| Miranol DM | 5.0 | 15.0 | 5.0 |
| Pegosperse 400 MS | — | — | 4.0 |
| EDTA (acid) | 3.0 | 3.0 | 4.0 |
| Tile Cleaning | Poor | Good | Good |

EXAMPLES 13–20

| | 13 | 14 | 15 | 16 | 17 | 18 | 19 | 20 |
|---|---|---|---|---|---|---|---|---|
| $H_2O$ (Deionized) | 83.0 | 80.5 | 82.5 | 81.0 | 79.0 | 80.5 | 83.5 | 81.0 |
| EDTA (4) | 4.0 | 4.0 | 4.0 | 4.0 | 4.0 | 4.0 | 4.0 | 4.0 |
| KOH (45%) | 5.0 | 5.0 | 5.0 | 5.0 | 5.0 | 5.0 | 5.0 | 5.0 |
| Miranol DM | 2.0 | 4.0 | 4.0 | 6.0 | 8.0 | 4.0 | 4.0 | 6.0 |
| Amphoterge S | — | — | — | — | — | — | — | — |
| Equex "S" (29%) | 0.5 | 0.5 | 0.5 | — | — | 0.5 | 0.5 | — |
| Pegosperse 400 MS | 5.0 | 5.0 | 3.0 | 3.0 | 3.0 | 5.0 | 3.0 | 3.0 |
| Triton X-100 | 0.5 | 1.0 | 1.0 | 1.0 | 1.0 | — | — | 1.0 |
| Triton N-101 | — | — | — | — | — | 1.0 | — | — |
| Gel Stability | yes | yes | yes | yes | yes | yes | yes | yes |
| Cleaning Effective-ness | yes | yes | yes | yes | yes | yes | yes | yes |

EXAMPLES 21-23

| | 21 | 22 | 23 |
|---|---|---|---|
| $H_2O$ (Deionized) | 82.0 | 82.0 | 83.5 |
| EDTA ($H_4$) | 4.0 | 4.0 | 4.0 |
| KOH (45%) | 5.0 | 5.0 | 5.0 |
| Miranol DM | 5.0 | 8.0 | — |
| Amphoterge S | — | — | 4.0 |
| Equex "S" (29%) | — | — | 0.5 |
| Pegosperse 400 MS | 4.0 | 1.0 | 3.0 |
| Gel Stability | yes | marginal | yes |
| Cleaning Effectiveness | yes | yes | yes |

EXAMPLES 24-31

| | 24 | 25 | 26 | 27 | 28 | 29 | 30 | 31 |
|---|---|---|---|---|---|---|---|---|
| $H_2O$ (Deionized) | 85.0 | 79.5 | 74.0 | 73.0 | 75.0 | 75.0 | 73.5 | 73.0 |
| EDTA ($Na_4$) | 5.0 | 10.0 | — | — | — | — | — | — |
| EDTA ($NH_4$) | — | — | — | — | 10.0 | 10.0 | — | — |
| EDTA ($H_4$) | — | — | 4.0 | 4.0 | — | — | 4.0 | 4.0 |
| KOH (45%) | — | — | 7.0 | 7.0 | — | — | 7.0 | 7.5 |
| Miranol DM | 10.0 | 10.0 | 15.0 | 15.0 | 15.0 | — | 15.0 | 15.0 |
| Amphoterge S | — | — | — | — | — | 15.0 | — | — |
| Equex "S" | — | 0.5 | — | — | — | — | — | 0.5 |
| Equex "SP" | — | — | — | — | — | — | 0.5 | — |
| BTC-2125 | — | — | — | 1.0 | — | — | — | — |
| Gel | * | * | * | * | * | * | yes | yes |
| Cleaning Effectiveness | yes | yes | no | no | no | * | yes | yes |

*Not Tested

EXAMPLES 32-38

| | 32 | 33 | 34 | 35 | 36 | 37 | 38 |
|---|---|---|---|---|---|---|---|
| $H_2O$ (Deionized) | 72.8 | 72.8 | 72.8 | 72.8 | 59.0 | 59.0 | 63.8 |
| KOH (45%) | 7.5 | 7.5 | 7.5 | 7.5 | 7.0 | 7.0 | 7.0 |
| EDTA ($H_4$) | 4.0 | 4.0 | 4.0 | 4.0 | 4.0 | 4.0 | 4.0 |
| Miranol DM | 15.0 | 15.0 | 15.0 | 15.0 | 5.0 | 10.0 | 10.0 |
| Emcol-TS-211 | 0.5 | 0.5 | — | — | — | — | — |
| Equex "S" | — | — | 0.5 | 0.5 | — | — | — |
| Sipon ES | — | — | — | — | 25.0 | 20.0 | 15.0 |
| Perfume | 0.2 | 0.2 | 0.2 | 0.2 | — | — | 0.2 |
| Dye | — | — | — | 0.001 | — | — | — |
| Gel Stability | yes | yes | no | yes | yes | yes | yes |
| Cleaning Effectiveness | yes | yes | * | yes | yes | yes | yes |

*Not Tested

EXAMPLES 39-42

| | 39 | 40 | 41 | 42 |
|---|---|---|---|---|
| $H_2O$ (Deionized) | 78.8 | 71.8 | 79.8 | 80.8 |
| KOH (45%) | 5.2 | 5.2 | 5.2 | 5.2 |
| EDTA ($H_4$) | 3.0 | 3.0 | 3.0 | 3.0 |
| Miranol DM | 8.0 | 15.0 | 10.0 | 10.0 |
| Miranol C2M-SF | 5.0 | 5.0 | 2.0 | 1.0 |
| Gel Stability | no | no | no | no |
| Cleaning Effectiveness | * | * | * | * |

*Not Tested

EXAMPLES 43-50

| | 43 | 44 | 45 | 46 | 47 | 48 | 49 | 50 |
|---|---|---|---|---|---|---|---|---|
| $H_2O$ (Deionized) | Bal. | Bal. | 80.0 | 82.5 | 78.5 | 81.0 | 89.5 | 89.5 |
| GAFAC RA-600 | 1.5 | — | — | — | — | — | — | — |
| Monoethanolamine | 4.5 | 30.0 | — | — | — | — | — | — |
| EDTA (acid) | 3.0 | 20.0 | — | — | — | — | — | — |
| ASE 200 | — | 10.0 | — | — | — | — | — | — |
| Miranol DM | — | — | 10.0 | 10.0 | 10.0 | 10.0 | — | — |
| 75% $H_3PO_4$ | — | — | 10.0 | — | 10.0 | — | 7.5 | — |
| Citric Acid | — | — | — | 7.5 | — | 7.5 | — | 7.5 |
| Monazoline | — | — | — | — | 1.5 | 1.5 | 2.0 | 2.0 |
| BTC-2125 (50%) | — | — | — | — | — | — | 1.0 | 1.0 |
| Gel Stability | * | * | * | * | * | * | no | no |
| Cleaning Effectiveness | no | no | no | no | yes | no | no | no |

*Not Tested

EXAMPLES 51-57

| | 51 | 52 | 53 | 54 | 55 | 56 | 57 |
|---|---|---|---|---|---|---|---|
| $H_2O$ (Deionized) | 85.0 | 80.0 | 75.0 | 70.0 | 75.0 | 81.0 | 82.5 |
| Miranol DM | 5.0 | 10.0 | 15.0 | 20.0 | 10.0 | 10.0 | 10.0 |
| 38% EDTA ($Na_4$) | 10.0 | 10.0 | 10.0 | 10.0 | 10.0 | — | — |
| Triethanolamine | — | — | — | — | 5.0 | — | — |
| GAFAC RA-600 | — | — | — | — | — | 1.5 | — |
| EDTA (acid) | — | — | — | — | — | 3.0 | 3.0 |
| Monoethanolamine | — | — | — | — | — | 4.5 | 4.5 |
| Gel Stability | no | yes | yes | * | * | * | * |
| Cleaning Effectiveness | no | yes | yes | no | yes | no | no |

*Not Tested

EXAMPLES 58-62

| | 58 | 59 | 60 | 61 | 62 |
|---|---|---|---|---|---|
| $H_2O$ (Deionized) | 80.0 | 76.0 | 85.0 | 75.0 | 74.0 |
| Miranol DM | 15.0 | 15.0 | 15.0 | 15.0 | 15.0 |
| 38% EDTA ($Na_4$) | 5.0 | 5.0 | — | 10.0 | 10.0 |
| Monoethanolamine | — | 4.0 | — | — | — |
| 50% Sodium Hydroxide | — | — | — | — | 1.0 |
| Gel Stability | * | * | * | no | no |

-continued

| | 58 | 59 | 60 | 61 | 62 |
|---|---|---|---|---|---|
| Cleaning Effectiveness | yes | no | no | yes | no |

*Not Tested

Note that in Example 61, there was difficulty in forming a stable gel due to the existence of iron impurities in the 38% solution of EDTA ($Na_4$).

What is claimed is:

1. A composition for cleaning tile and grout consisting essentially of:

(a) from about 1.5 to 7 weight percent of an alkaline hydroxide or an ammonium salt of a member selected from the group consisting of nitrioltriacetic acid and alkaline polyamine polycarboxylic acids having the formula:

$$(HOOCCH_2)_2N[(CH_2)_xNCH_2COOH]_yCH_2COOH$$

wherein x and y may each independently be from 1 to 7, and wherein the weight percent is expressed on a free acid basis;

(b) from about 1.0 to 3.0 weight percent of an alkaline hydroxide selected from the group consisting of the hydroxides of potassium, sodium and ammonium, the amount of hydroxide being such as to combine with the sequestering agent to form a salt thereof, resulting in substantially no free hydroxide in the composition;

(c) from about 1.0 to 4.0 weight percent of 2-heptadecyl-1-carboxymethyl-1-)2-hydroxyethyl)-2-imidazolinium chloride; and (d) the balance being water, wherein the composition is capable of existing as a thixotropic gel at room temperature and of forming a water-impermeable outer skin upon application of the composition to the tile or grout surface.

2. The composition of claim 1 additionally including up to about 6 weight percent of polyethylene glycol monostearate.

3. The composition of claim 1 additionally including up to about 0.15 weight percent of sodium lauryl sulfate.

4. The composition of claim 1 wherein the sequestering agent is ethylenediaminetetraacetic acid.

* * * * *